US011718897B2

(12) United States Patent
Forsik et al.

(10) Patent No.: US 11,718,897 B2
(45) Date of Patent: Aug. 8, 2023

(54) PRECIPITATION HARDENABLE COBALT-NICKEL BASE SUPERALLOY AND ARTICLE MADE THEREFROM

(71) Applicant: CRS HOLDINGS, LLC, Wilmington, DE (US)

(72) Inventors: Stephane Forsik, Reading, PA (US); Alberto Polar-Rosas, Reading, PA (US); Tao Wang, Reading, PA (US); Samuel Kernion, Lancaster, PA (US); Mario Epler, Denver, PA (US); Ning Zhou, Sinking Spring, PA (US)

(73) Assignee: CRS HOLDINGS, LLC, Wilmington, DE (US)

( * ) Notice: Subject to any disclaimer, the term of this patent is extended or adjusted under 35 U.S.C. 154(b) by 152 days.

(21) Appl. No.: 17/714,518

(22) Filed: Apr. 6, 2022

(65) Prior Publication Data

US 2022/0380867 A1 Dec. 1, 2022

Related U.S. Application Data

(63) Continuation of application No. 15/958,454, filed on Apr. 20, 2018, now abandoned.

(60) Provisional application No. 62/488,294, filed on Apr. 21, 2017.

(51) Int. Cl.

| | |
|---|---|
| ***C22C 19/07*** | (2006.01) |
| ***C22C 30/00*** | (2006.01) |
| ***C22C 19/05*** | (2006.01) |

(52) U.S. Cl.

CPC ..... *C22C 19/07* (2013.01); *C22C 19/056* (2013.01); *C22C 19/057* (2013.01); *C22C 30/00* (2013.01)

(58) Field of Classification Search

CPC ..... C22C 19/056; C22C 19/057; C22C 19/07; C22C 30/00

See application file for complete search history.

(56) References Cited

FOREIGN PATENT DOCUMENTS

JP WO2006059805 * 6/2006 ..... C22C 19/05

OTHER PUBLICATIONS

English Machine Translation of JPWO 2006059805 (Year: 2022).*

* cited by examiner

*Primary Examiner* — Alexandra M Moore

(74) *Attorney, Agent, or Firm* — Dann, Dorfman, Herrell and Skillman, P.C.

(57) ABSTRACT

A precipitation hardenable, cobalt-nickel base superalloy is disclosed. The is characterized by the following weight percent composition.

| | |
|---|---|
| C | about 0.01 to about 0.15 |
| Cr | about 6.00 to about 15.00 |
| Ni | about 30.00 to about 45.00 |
| W | about 3.00 to about 15.00 |
| Ti | about 0.50 to about 4.00 |
| Al | about 3.00 to about 7.00 |
| Nb | up to about 2.50 |
| Ta | up to about 6.00 |
| Hf | up to about 1.50 |
| Zr | up to about 1.50 |
| B | up to about 0.20 |
| Mo | up to about 2.50 |
| Si | up to about 1.50 |

The balance of the alloy is cobalt and usual impurities. The alloy provides a novel combination of strength and ductility after long-term exposure to elevated operating temperatures as found in gas turbines and jet engines. A fine-grain steel article made from the alloy is also disclosed. The steel article (Continued)

is also characterized by a continuous surface layer of $Al_2O_3$ and $Cr_2O_3$ that protects the alloy from oxidation at the elevated operating temperatures.

5 Claims, 8 Drawing Sheets

PRECIPITATION HARDENABLE COBALT-NICKEL BASE SUPERALLOY AND ARTICLE MADE THEREFROM

CROSS-REFERENCE TO RELATED APPLICATION

This application is a continuation of U.S. patent application Ser. No. 15/958,454, filed Apr. 20, 2018, which claims the benefit U.S. Provisional Application No. 62/488,294, filed Apr. 21, 2017, the entireties of which are incorporated herein by reference.

BACKGROUND OF THE INVENTION

Field of the Invention

This invention relates to superalloys for very high temperature applications and to a precipitation hardenable cobalt-nickel base superalloy that provides good resistance to oxidation, very good strength, and microstructural stability at significantly higher temperatures than known nickel-base and known cobalt-base superalloys. The invention also relates to a fine-grained article made from the alloy.

Description of the Related Art

To obtain better fuel efficiency and performance in gas turbine generators and jet engines than currently available, the manufacturers of such equipment are designing the next generation of the gas turbines to run at significantly higher temperatures than those currently in use. Nickel-base superalloys such as INCONEL® 718, INCONEL® 706, and WASPALOY have been used to make gas turbine rotors and other components. The known nickel-base superalloys provide very good strength and resistance to creep at temperatures up to about 750° C. (1380° F.). However, it is expected that the newer gas turbine designs will require a superalloy that can provide high strength at temperatures of 800° C. (1472° F.) and higher.

The known nickel-base precipitation hardening superalloys obtain their elevated temperature strength primarily through the precipitation of the intermetallic phase gamma prime (γ') in the alloy matrix material. The solvus temperature of the nickel-base γ' in WASPALOY is about 1020° C. (1870° F.). Consequently, the known nickel-base superalloys undergo a rapid decline of strength and creep resistance when the in-service operating temperature approaches that temperature. In view of the expected move to higher operating temperatures for gas turbines and jet engines, a need has arisen for a precipitation hardenable superalloy that provides very high strength and very good creep resistance at a temperature greater than 675° C. (1250° F.) in a 1000-hour test at 630 MPa (91.4 ksi).

It is known that cobalt-nickel alloys containing Al and W can be strengthened by the precipitation of the $LI_2$ ordered phase, γ' precipitate ($Co_3$(Al, W)) and by the precipitation of the $Ni_3$(Al, Ti) γ' precipitate found in the known Ni-base superalloys. However, in practice, it has been found that the ternary Co—W—Al phase alone does not provide sufficiently improved properties compared to existing Ni base alloys, especially during long term high temperature exposure. Also, the ternary Co—W—Al phase suffers from accelerated oxidation during high temperature exposure, which results in a loss of mass in the alloy and consequently, a reduction of service life at such temperatures.

Accordingly, there is a need for a superalloy having a combination of properties for very high temperature applications, namely strength, creep resistance, oxidation resistance, and long term stability.

BRIEF SUMMARY OF THE INVENTION

The disadvantages of the known nickel and cobalt base superalloys as described above are resolved to a large degree by a cobalt-base superalloy having a novel chemistry that is designed to provide a desired combination of mechanical properties and oxidation resistance for the next generation of gas turbines and jet engines. In accordance with the present invention there is provided a precipitation hardenable cobalt-base superalloy having the following broad and preferred compositions in weight percent.

| | Broad | Preferred |
|---|---|---|
| c | 0.01-0.15 | 0.02- 0.10 |
| Cr | 6.00-15.00 | 7.00-9.80 |
| Ni | 30.00-45.00 | 34.00-41.00 |
| W | 3.00-15.00 | 3.00-12.00 |
| Ti | 0.50-4.00 | 0.60-2.00 |
| Ta | 0-6.00 | 0.50-5.00 |
| Hf | up to 1.50 | up to 0.50 |
| Al | 3.00-7.00 | 3.00-5.00 |
| Nb | up to 2.50 | up to 2.00 |
| Zr | up to 1.50 | up to 1.00 |
| B | up to 0.20 | up to 0.10 |
| Mo | up to 2.50 | up to 2.00 |
| Si | up to 1.50 | up to 1.00 |

The balance of the alloy composition is cobalt and the usual impurities found in precipitation hardenable superalloys intended for the same or similar service or use.

In the solution treated and age hardened condition, the alloy according to this invention is designed to provide a yield strength of about 700-1380 MPa (100-200 ksi) at a temperature of 650-815° C. (1200-1500° F.). The alloy is also designed to ensure the stability of the γ' strengthening precipitate when the alloy is exposed to a temperature of about 700-1050° C. (1300-1920° F.) for 1000 hours or more.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of a broad range can be used with the maximum or minimum for that element from a preferred range.

Here and throughout the Specification and Claims of this application the term "percent" and the symbol "%" mean percent by weight or percent by mass, unless otherwise indicated. Also, the symbol γ identifies the matrix material and γ' and γ" identify the intermetallic precipitates that are present in the alloy after a two-step heat treatment including solution annealing and age hardening steps.

BRIEF DESCRIPTION OF THE DRAWINGS

The foregoing summary as well as the following detailed description will be better understood when read in conjunction with the Drawings, wherein.

DETAILED DESCRIPTION OF THE INVENTION

Figure 1A:
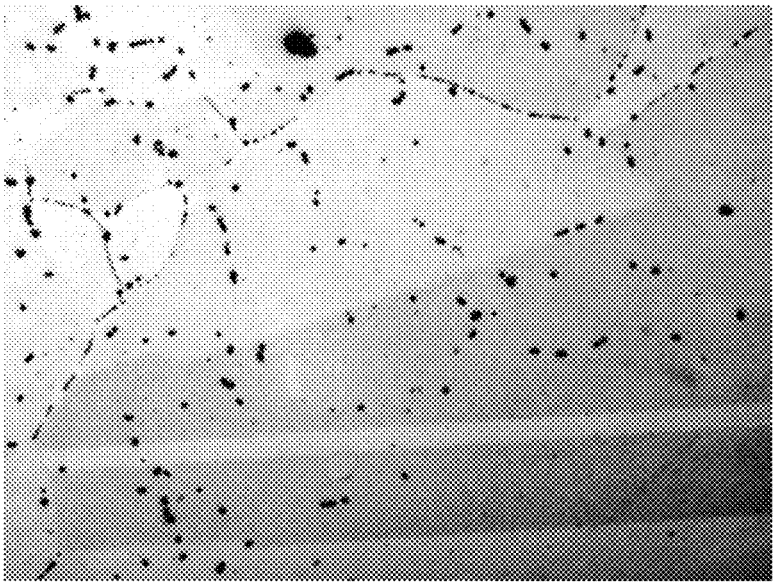
FIG. 1A is an optical photomicrograph of a sample of the alloy according to the present invention at a magnification of 1000× after exposure to a temperature of 704 C (1300 F) for 100 hours.

At least about 0.01% and preferably at least about 0.02% carbon is present in this alloy. Carbon benefits the high strength and good creep resistance provided by the alloy at elevated temperatures by combining with other elements to form carbides. Among the beneficial carbides present in this alloy are MC, $M_{23}C_6$, $M_6C$, and $M_7C_3$ carbides where M is one or more of the elements chromium, molybdenum, tungsten, titanium, tantalum, and hafnium. Too much carbon does not provide an additional benefit to strength and adversely affects the high temperature oxidation resistance provided by this alloy. Therefore, carbon is limited to not more than about 0.15% in this alloy and preferably to not more than about 0.10%.

This alloy contains at least about 3.00% tungsten and at least about 3.00% aluminum. Tungsten and aluminum combine with cobalt in this alloy to form a cobalt-base γ' precipitate ($Co_3(Al, W)$) after solution annealing and age hardening heat treatments. The cobalt-base γ' phase in the ternary Co—Al—W alloy system is metastable because it decomposes to γ, B2, and $D0_{19}$ phases when exposed to temperatures of about 900° C. (1650° F.) for very long periods of time. In order to stabilize the cobalt-base γ' phase, controlled amounts of nickel and titanium are included in the alloy as described further below. It is expected that the solvus temperature of the cobalt-base γ' in the Co—Al—W—Ni—Ti system will be greater than about 1050° C. (1922° F.). The retention of a substantial amount of the γ' phases in this alloy at the anticipated operating temperatures of the next generation of gas turbines and jet engines will result in a significant retention of the strength and creep resistance provided by the alloy. Aluminum also contributes to the good elevated temperature oxidation resistance and corrosion resistance provided by this alloy. In this regard, aluminum combines with available oxygen to form an $Al_2O_3$ oxide layer on the surface of products made from the alloy that, when formed as a continuous layer, protects the alloy against further oxidation. The $Al_2O_3$ layer is continuous when it has substantially no openings or discontinuities through which oxygen can easily penetrate. The chemistry balance in the claimed alloy in this patent promotes the formation of the continuous $Al_2O_3$ layer at temperatures above 800° C. (1472 F). Too much aluminum and/or tungsten promotes the precipitation of deleterious phases such as B2 and $D0_{19}$. Therefore, aluminum is restricted to not more than about 7.00% and preferably to not more than about 5.00% in the alloy of this invention. Tungsten is limited to not more than about 15.00% and preferably to not more than about 12.00% in this alloy.

Titanium substitutes for some of the aluminum in the cobalt-base γ' strengthening precipitate that forms in this alloy and thus increases the range of chemistries that provide γ' precipitate that is stable at the elevated temperatures experienced during the operation of gas turbines and jet engines. Titanium also benefits the strength provided by the alloy by increasing the solvus temperature of the γ' strengthening precipitate. Accordingly, the alloy contains at least about 0.50% and preferably at least about 0.60% titanium. Too much titanium results in the formation of undesirable secondary phases such as B2, for example. For that reason, the alloy contains not more than about 4.00% titanium and preferably not more than 2.00%.

Up to about 6.00% tantalum may be present in this alloy because it provides the same benefits as titanium. Tantalum also contributes to the solid solution strength provided by this alloy. Preferably, the alloy contains at least about 0.50% and better yet contains at least about 2.00% tantalum. Like titanium, too much tantalum can result in the formation of undesirable secondary phases such as Mu (μ) and Laves phases. Therefore, the amount of tantalum in this alloy is restricted to not more than about 6.00% and preferably to not more than about 5.00%.

At least about 6.00%, better yet at least about 7.00%, and preferably at least about 8.00% chromium is present in this alloy to benefit the oxidation resistance and the corrosion resistance of the alloy (including general corrosion resistance and localized corrosion resistance) at the elevated temperatures encountered in gas turbines and jet engines. When present in an amount of 8% or more, chromium acts as an oxygen getter promoting the formation of protective, dense $Cr_2O_3$ phase that contributes to the formation of more internal, protective, continuous adherent layer of $Al_2O_3$. Too much chromium can lead to the formation of undesirable secondary phases such as μ and B2. μ phase is considered to be an undesirable TCP phase in this alloy that might precipitate intergranularly and intragranularly. One of the working examples described below which contained more than 10% chromium showed a considerable amount of those precipitates. (See, FIG. 1). Mu phase also adversely affects the high temperature mechanical properties of this alloy during the long-term exposure. The μ phase also adversely affects the corrosion resistance and oxidation resistance provided by the alloy according to this invention.

Additionally, it was observed that when the amount of chromium is above about 9.8%, the solvus temperature of γ' is reduced. That effect lowers the strengthening capability of this alloy at temperatures above 1000 C (1832 F). For all of the foregoing reasons chromium is limited to not more than about 15.00% or 12.00% and preferably to not more than about 9.8% in this alloy, for example not more than either 9.5% or 9.0%.

Nickel combines with available aluminum and titanium to form the nickel-base γ' strengthening phase during heat treatment of the alloy. Nickel also stabilizes the cobalt-base γ' phase and adjusts the γ/γ' mismatch to a more beneficial range. The γ/γ' mismatch is a parameter known to persons skilled in the art and is defined by the following relationship: ((lattice parameter of the precipitate−lattice parameter of the alloy matrix)÷ (lattice parameter of alloy matrix))×100%. A coherent interface between the γ matrix material and the γ' precipitates is necessary to obtain a stable microstructure and is produced when the absolute value of the γ/γ' mismatch parameter is as small as possible. For the reasons described above, the alloy of this invention contains at least about 30.00% and preferably at least about 34.00% nickel. Because nickel additions lessen the amount of cobalt in the alloy balance, too much nickel will reduce the benefits of having cobalt as the main alloying element in this alloy. Accordingly, the alloy contains not more than about 45.00% and preferably not more than about 41.00% nickel.

The alloy may contain up to about 1.50% zirconium which benefits the elevated temperature corrosion resistance of the alloy. At least about 0.02% zirconium is present in the alloy to obtain the desired benefit. Preferably, the alloy contains not more than about 1.00% zirconium. The alloy of this invention may also contain up to about 0.20% boron which contributes to the grain boundary strength and resistance to oxidation provided by the alloy. At least about 0.02% boron is present for those purposes. Preferably, the alloy contains not more than about 0.10% boron. The alloy may optionally contain up to about 2.50% niobium which benefits the elevated temperature strength provided by the alloy by solid solution strengthening and by combining with nickel to form the γ" strengthening phase. However, too much niobium can result in the formation of undesirable secondary phases such as μ and Laves phases. Therefore, it is preferred that the alloy contain no more than about 2.00% niobium.

Hafnium is a strong MC type carbide former. When present, it forms fine HfC which frees up tungsten and titanium from forming MC carbide and makes those elements available for the main strengthening phase gamma prime. A small amount of hafnium also promotes the formation of serrated (convoluted) grain boundaries which improve the stress rupture and dwell fatigue life properties provided by the alloy. A small but effective amount of Hf increases high temperature corrosion and sulfidation resistance in this alloy. It has been found that too much hafnium can significantly depress the solidus temperature which leads to incipient melting when the alloy is hot worked. Therefore, the alloy contains not more than about 1.50% and preferably not more than about 0.50% hafnium.

Up to about 2.50% molybdenum may also be present in this alloy in substitution for some of the tungsten to lower the density of the alloy. Molybdenum also benefits the creep resistance provided by the alloy. Preferably, however, the alloy contains not more than about 2.00% molybdenum to avoid the formation of undesired phases such as μ and $D0_{19}$. This alloy may further contain up to about 1.50% silicon to promote the formation of a protective surface layer during elevated temperature oxidation of the alloy. Too much silicon can result in spalling of the oxidation protective layer. Therefore, the alloy preferably contains not more than about 1.00% silicon.

The balance of the alloy is cobalt and the usual impurities found in commercial grades of superalloys intended for similar service. Preferably the alloy contains about 35.00-43.00% cobalt.

The foregoing elements and their weight percent ranges are selected to provide a novel combination of properties. As noted previously above, the alloy is designed to provide a γ' solvus temperature greater than about 1050° C. (1922° F.) so that the alloy can provide high strength and good resistance to creep when used at higher operating temperatures than currently used in gas turbines and jet engines. The alloy composition is also selected to ensure that undesirable secondary phases such as the $D0_{19}$, B2, μ, and Laves phases, dissolve at significantly lower temperatures than the γ' strengthening phases. In order to realize high strength at elevated temperatures, the alloy is designed to provide more than about 45 volume percent of the γ' strengthening phases in the solution treated and age hardened condition. The alloy composition is further designed to provide a hot workability window that is greater than about 110° C. (200° F.). The hot workability window is defined as the difference between the γ' solvus temperature and the solidus temperature. It represents the temperature range wherein the alloy can be readily hot worked.

No special melting techniques are required to produce the alloy of this invention. Preferably, the alloy is melted by vacuum induction melting (VIM) and refined by consumable electrode remelting such as electroslag remelting (ESR) and/or vacuum arc remelting (VAR). For critical applications, a triple melt process comprising VIM+ESR+VAR can be used. The remelted ingot is typically hot worked to an intermediate shape and size. In order to get the optimal mechanical properties as well as long term stability at high temperature, this alloy is preferably thermomechanically processed. More specifically, the cast ingot is heated at a temperature that is selected to provide homogenization of the alloy chemistry within the ingot. The homogenization temperature is selected mainly based on the chemical composition of the alloy ingot and is preferably not less than about 1120 C (2050 F). The time at temperature for each step selected based on the ingot size.

After the homogenization cycle is completed, the material is hot worked preferably from a temperature not greater than about 1205 C (2200 F). A subsequent hot forming process may be applied to the alloy material to additional deformation. The additional hot forming step, which may include, one or more of pressing, forging, hot rolling, roll forming, or a similar hot working technique, is performed from a starting temperature at or near the γ' solvus temperature. The additional hot forming step imparts a sufficient amount of strain at an appropriate strain rate to achieve the desired microstructure. Preferably, the hot forming temperature for the billet material is not higher than about 1120 C (2050 F). The combination of novel chemistry and thermomechanical processing has been found by the inventors to provide a fine-grained structure with an ASTM grain size number of 6 to 12. Preferably, the alloy is characterized by a grain size number greater than 8. The alloy may also be cold worked to a limited degree after the thermomechanical processing.

Product forms of the alloy such as bars, billets, strip, wire, and rod are heat treated to develop the very high strength that characterizes the alloy. In this regard the alloy is solution treated at a temperature of 871 to 1260 C (1600 to 2300 F) for 0.1 to 100 hours and then age hardened in single or multiple steps at a temperature of 482 to 871 C (900 to 1600 F) for 0.1 to 100 hours. The temperature, time, and cooling parameters for the solution treatment and age hardening treatment will vary depending on the cross-sectional size of the alloy material and the combination of strength, stress rupture, and creep resistance required for the intended application for the alloy.

The mechanical properties provided by the alloy of this invention exceed the typical properties provided by the known Ni based superalloys, like Waspaloy, INCONEL® 718, and others, at temperatures higher than 650 C (1200 F). The superior combination of mechanical properties at such temperatures makes the alloy of this invention suitable for use in the next generation of gas turbines and jet engines.

The good stability of the strengthening microconstituents, mainly γ', is reflected in stable mechanical properties after exposure at temperature of 815 C (1500 F) or higher for at least 1000 hrs. This particular characteristic of the present alloy results in longer lifetime for parts and components made from the alloy. Additionally, the high temperature oxidation resistance of the present invention is superior to the known commercial Ni based superalloys. After 600 hours of cyclic testing at 1472 F (800 C), 1832 F (1000 C) and 2012 F (1100 C), the alloy according to this invention provides better resistance to oxidation which results in less mass loss and thus, to longer life in elevated temperature service.

Working Examples

In order to demonstrate the novel and advantageous combination of properties provided by the alloy of this invention, six (6) 40-lb. heats were vacuum melted. The weight percent chemistries of the heats are set forth in the following table.

| | Cr | Ni | Co | Al | W | Ti | Ta | Zr | B | C | Si |
|---|---|---|---|---|---|---|---|---|---|---|---|
| EX-2969 | 9.08 | 36.01 | 41.68 | 4.29 | 6.35 | 2.52 | — | — | — | — | — |
| EX-3015 | 8.59 | 34.05 | 38.77 | 4.1 | 11.91 | 1.31 | 1.18 | 0.05 | 0.01 | 0.039 | 0.01 |
| EX-3031 | 8.91 | 40.11 | 35.76 | 4.25 | 9.13 | 1.65 | 0.02 | 0.05 | 0.009 | 0.033 | 0.03 |
| EX-3033 | 8.7 | 34.44 | 39.05 | 4.09 | 11.95 | 1.62 | 0.01 | 0.05 | 0.011 | 0.032 | 0.03 |
| EX-3121 | 8.85 | 38.92 | 35.91 | 4.23 | 9.82 | 1.62 | 0.53 | 0.05 | 0.01 | 0.046 | 0.01 |
| EX-3078 | 13.82 | 37.82 | 34.09 | 4.03 | 8.65 | 1.56 | — | 0.06 | 0.009 | 0.029 | 0.02 |

The ingots of the examples were homogenized for 24 hrs. and then hot forged down to 1.0 in. square bars. Standard specimens for tensile testing were machined from blanks cut from the bars. The tensile specimens of each example were solution annealed at 2000 F for 1 hour, quenched in oil, and then aged at 1450 F for 24 hours before testing was performed.

Example EX-3121

Figure 2:
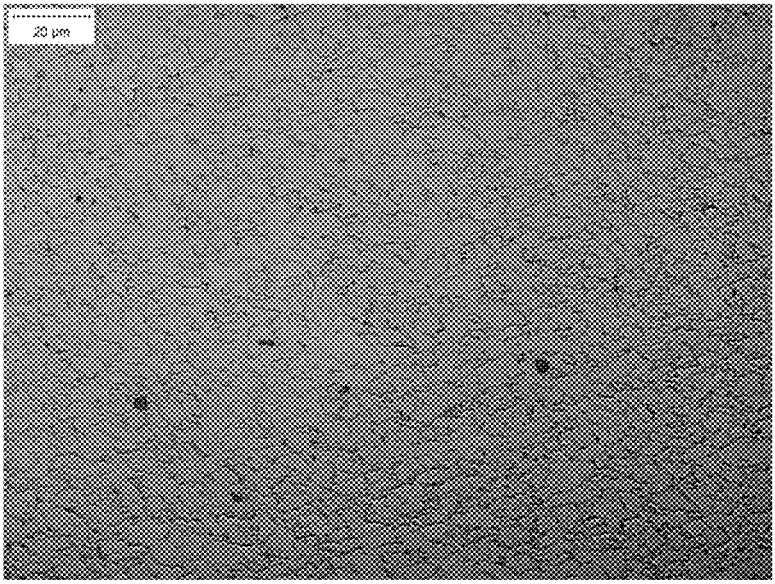
FIG. 2 is an optical photomicrograph of a sample of the alloy of this invention at a magnification of 500× after thermomechanical processing.

Metallographic specimens of the material from EX-3121 were prepared from the bar material and examined to determine the microstructure of the material in the heat-treated condition after hot working. FIG. 2 shows the fine grain structure (ASTM grain size number 11) of the material from EX-3121.

Examples EX-3015 and EX-3031

Figure 3:
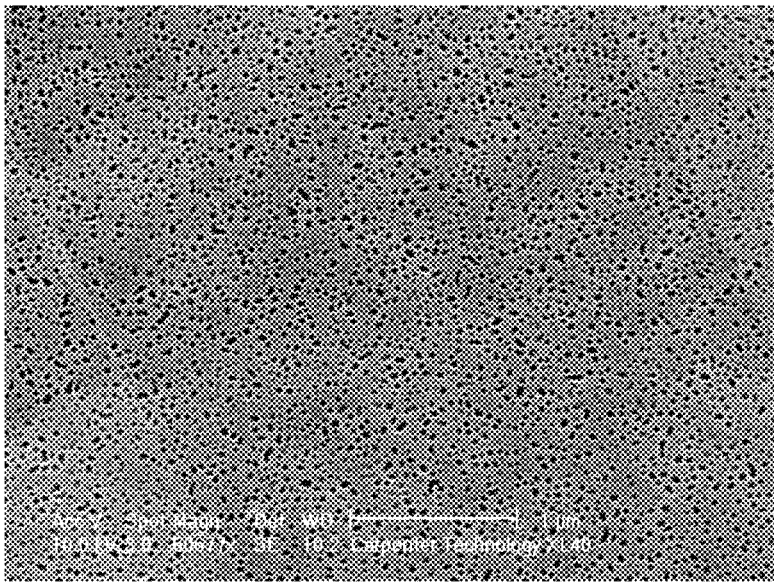
FIG. 3 is an FEG-SEM image of material from a sample of the alloy at a magnification of 50677×.

Specimens of the material from the bars of Example EX-3015 were obtained for analysis of the microstructure. FIG. 3 is a field emission gun—scanning electron microscope (FEG-SEM) image of the microstructure of the material from Example EX-3015 in the aged condition. It can be seen from FIG. 3 that the material has a microstructure consisting of a matrix of γ phase with a substantial quantity of submicron-size γ' particles that are uniformly dispersed within the matrix material.

Figure 4:
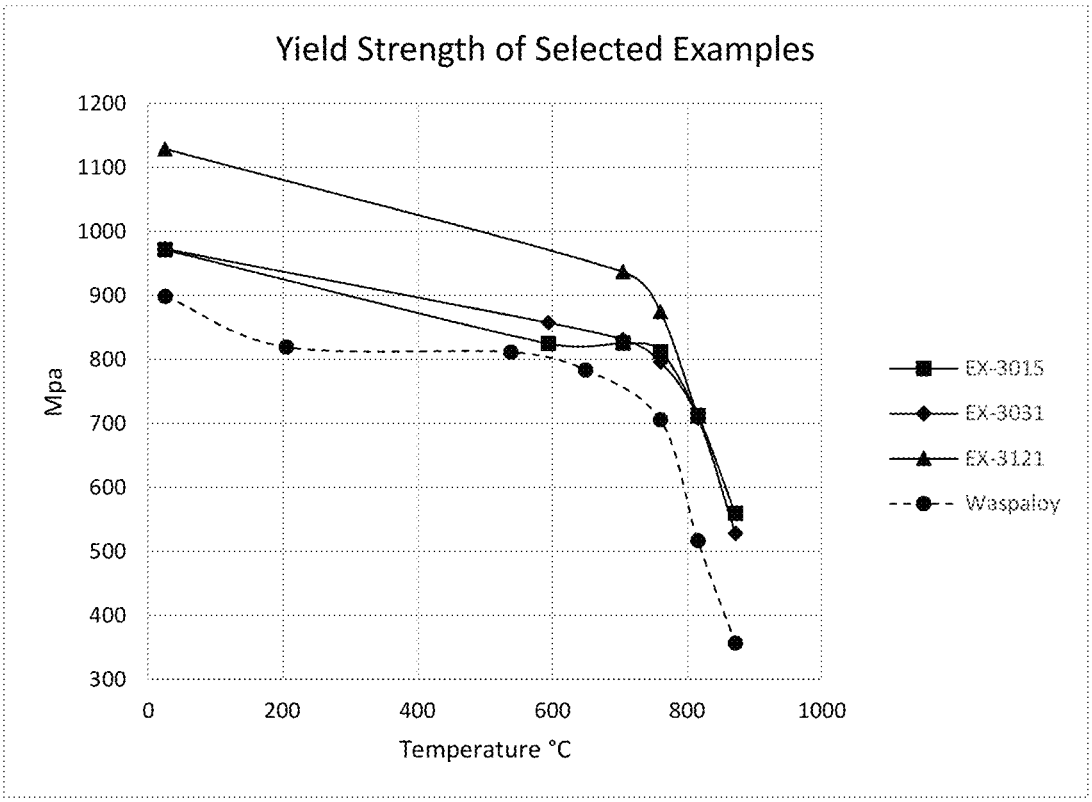
FIG. 4 shows graphs of yield strength as a function of temperature for samples of the alloy of this invention and Waspaloy.

Tensile testing of samples of Examples EX-3015, EX-3031, and EX-3121 was performed at 24 C (76 F), 593 C (1100 F), 704 C (1300 F), 760 C (1400 F), 815 C (1500 F), and 870 C (1600 F). Graphs of the yield strength provided by Examples EX-3015, EX-3031, and EX-3121 at each test temperature are presented in FIG. 4. For comparison, a graph of the yield strength of similarly prepared samples of the Waspaloy alloy is also shown in FIG. 4. It is readily apparent from FIG. 4 that the yield strengths of Examples EX-3015, EX-3031, and EX-3121 are significantly higher than the yield strength of the Waspaloy material, particularly at temperatures above 600 C (1112 F).

Figure 7:
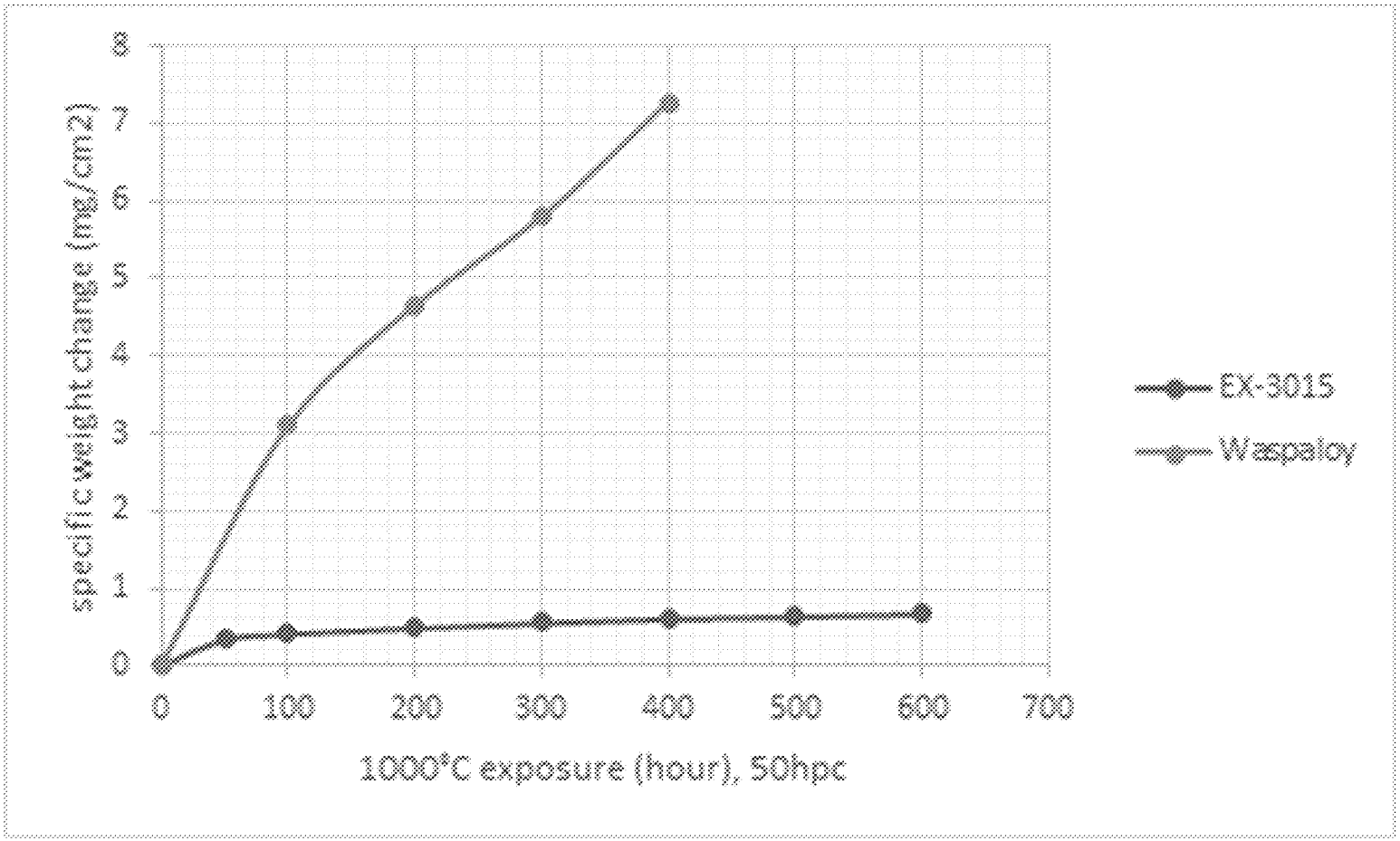
FIG. 7 shows graphs of oxidation rate (specific weight change) as a function of hours at 1000 C for samples of the alloy of this invention and samples of Waspaloy.

Samples of EX-3015 were tested for oxidation rate compared to similarly prepared samples of the Waspaloy. FIG. 7 shows the oxidation rates of the sample material from Example EX-3015 and the samples of the Waspaloy.

Example EX-3033

Figure 5A:
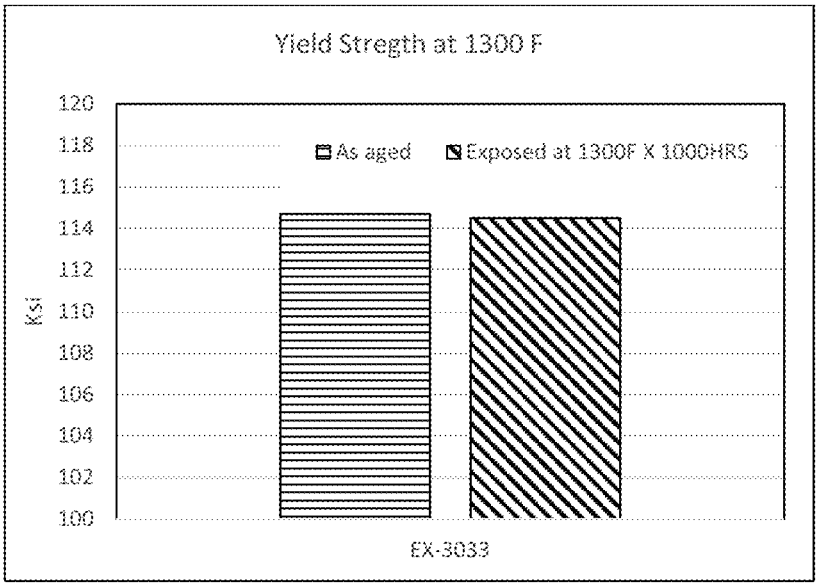
FIG. 5A is a bar chart of yield strength for a sample of the alloy in the aged condition and after exposure to a temperature of 704 C (1300 F) for 1000 hours.
Figure 5B:
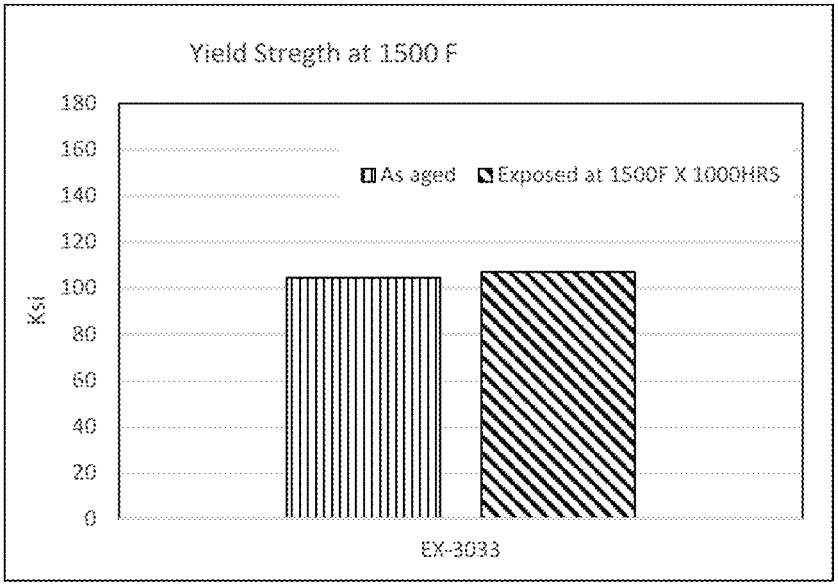
FIG. 5B is a bar chart of yield strength for a second sample of the alloy in the aged condition and after exposure to a temperature of 815.5 C (1500 F) for 1000 hours.

The aged test samples of EX-3033 were tensile tested at 704 C (1300 F) and 815 C (1500 F) and provided a yield strength of 791 MPa (114.7 ksi) at the first temperature and a yield strength of 720.5 MPa (104.5 ksi) at the second temperature. Additionally, a set of test coupons was placed in a furnace running at 1300 F (704 C) and held in an isothermal condition for 1000 hrs. A second set of test coupons was placed in a furnace running at 1500 F (815 C) and held in an isothermal condition for 1000 hrs. After the 1000-hour exposures to the described temperatures, tensile samples were machined from the test coupons and tensile tested at the same temperature they were exposed to, nominally 1300 F and 1500 F. The samples tested 1300 F provided a yield strength of 789.5 MPa (114.5 ksi) and the samples tested at 1500 F 738 MPa (107.0 ksi). Those results show that the alloy according to this invention is very stable during long term exposure at high temperature, which ensures a very reliable performance in service. The results of the elevated temperature tensile testing are presented graphically in FIGS. 5A and 5B.

Example EX-2969

Example EX-2969 was tested for resistance to high temperature oxidation resistance. Cylindrical samples 0.5" (12.65 mm) height and 0.5" (12.65 mm) diameter were prepared from the 1.0 in bars and surface finished with 400 grit polishing agent. Additional samples in the as-heat treated condition were also prepared from commercially available Waspaloy. All samples were placed in open crucibles and then exposed to a cyclic oxidation at 600 C, 800 C, 1000 C and 1100 C for a total of 600 hrs. After each 50-hour cycle, samples were allowed to cool down covered by a ceramic lid to prevent loss of spalling material. After the cyclic exposures, all samples showed a continuous layer of $Al_2O_3$ attached to the base metal and underneath other metals oxides. It is known that $Al_2O_3$ with corundum structure provides a protective barrier against the further diffusion of oxygen ions into the metal, and thereby reduces the oxidation rate of the metal at high temperatures. The protective action of $Cr_2O_3$, the other oxide with a corundum structure, stops above 1800 F because at this temperature and in the presence of oxygen, $Cr_2O_3$ can react to give $CrO_3$ which is less protective and more volatile.

Figure 6:
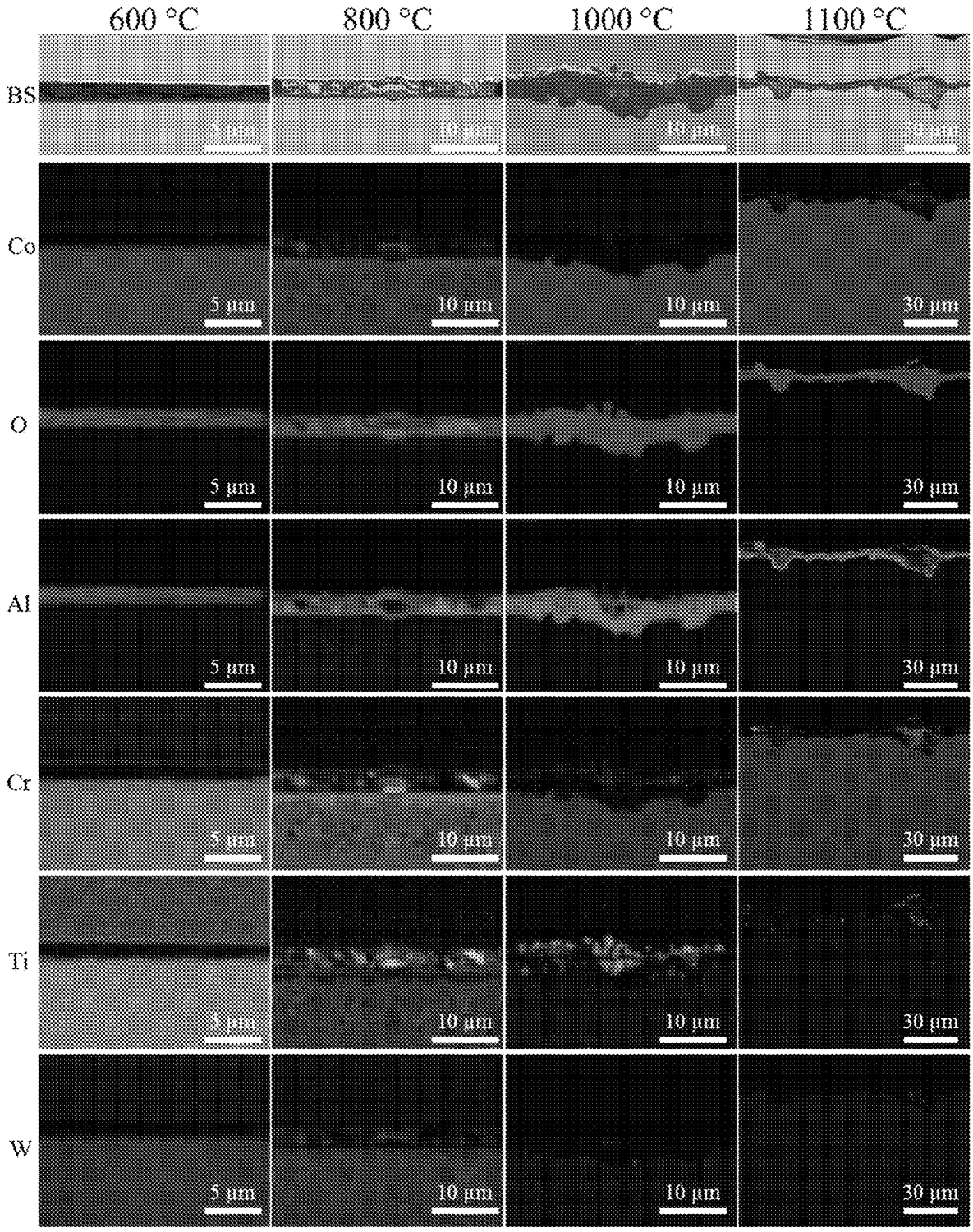
FIG. 6 shows a BS image and EDS maps for Ni, Co, O, Al, Cr, Ti, and W from a sample of the alloy according to this invention.

The continuous protective aluminum oxide layer does not form spontaneously in every Al-bearing alloy. Therefore, it is necessary to balance the constituent elements in order to control the mobility of the oxygen anion and to allow the continuous layer to build up. Otherwise, a discontinuous aluminum oxide layer is formed that exposes the grain boundaries to further oxidation. FIG. 6 shows an EDS map of material from Example EX-2969 showing the presence of the continuous layer of aluminum oxide attached to the base alloy and other oxides (e.g., Cr-oxide, Ti-oxide, and W-oxide).

Example EX-3078

Figure 1B:
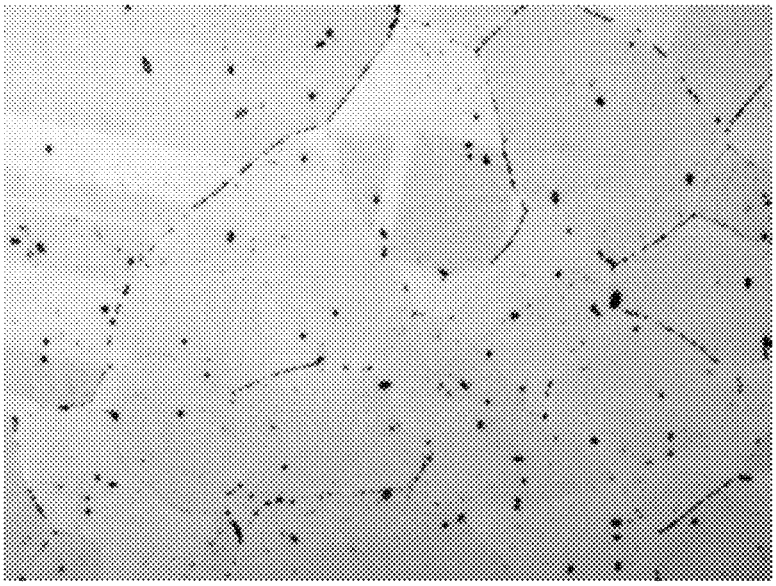
FIG. 1B is an optical photomicrograph of a second sample of the alloy at a magnification of 1000× after exposure to a temperature of 760 C (1400 F) for 100 hours.
Figure 1C:
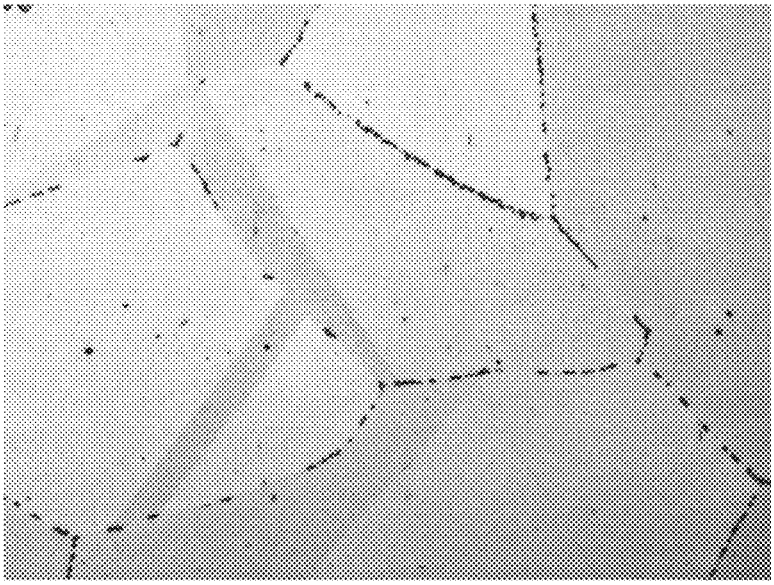
FIG. 1C is an optical photomicrograph of a third sample of the alloy at a magnification of 1000× after exposure to a temperature of 815.5 C (1500 F) for 100 hours.
Figure 8:
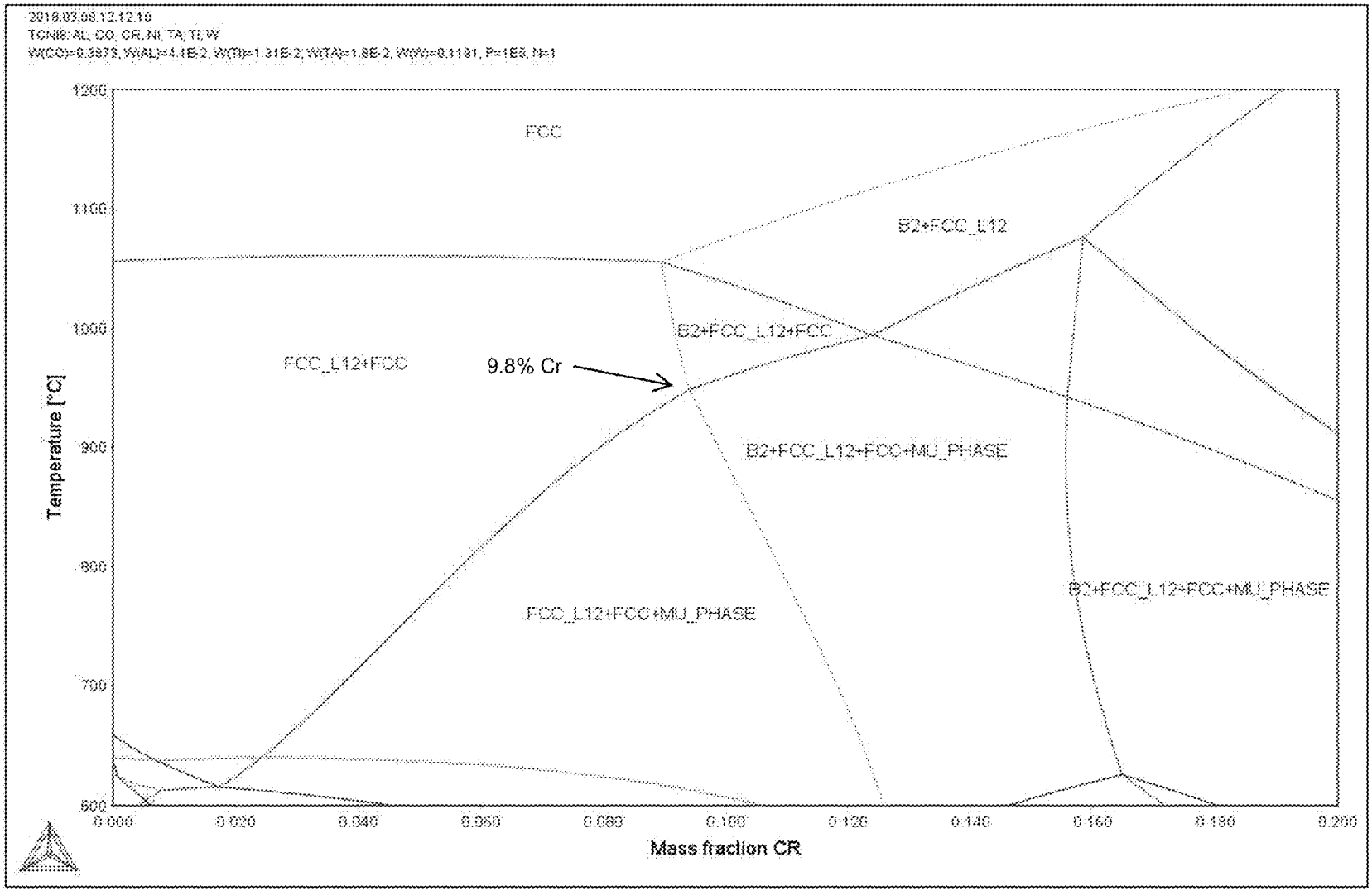
FIG. 8 is an alloy phase diagram for the alloy according to the present invention prepared using the THERMO-CALC® alloy modeling software.

Example EX-3078 has higher Cr (13.82%) compared with the other examples which are in a range of 8.5% to 8.98%. It was found that the larger amount of Cr in example EX-3078 stabilizes the deleterious μ phase within the heat-treating temperature ranges as predicted by the THERMO-CALC® software and shown in FIG. 8. FIG. 8 shows that the maximum solubility of Cr in the preferred chemical composition of the alloy according to the present invention is about 9.8% and occurs at a temperature of 940 C. The aging heat treatment to precipitate the gamma prime phase in this alloy is carried out at temperatures below 850 C, which will induce the precipitation of μ phase. That finding was confirmed by optical microscopy as shown in FIGS. 1A-1C which show substantial precipitation of μ phase in the alloy matrix and at grain boundaries after exposure to temperatures of 704 C (1300 F) (FIG. 1A), 760 C (1400 F) (FIG. 1B), and 815.5 C (1500 F) (FIG. 1C). As a result of those findings, the alloy preferably contains less than 9% chromium.

In view of the foregoing disclosure, it can be seen that the cobalt-nickel base superalloy according to the present invention provides a novel combination of properties including good strength and ductility at temperatures higher than the currently known operating temperatures of gas turbines and jet engines. Moreover, the microstructure of the alloy is stable at such temperatures such that long-term exposure to such temperatures (e.g., at 1500 F) does not degrade the strength and ductility provided by the alloy. In this regard the composition of the alloy is balanced to inhibit the formation of undesirable TCP phases such as μ-phase. The alloy according to this invention also provides a good resistance to oxidation at such temperatures because it forms a continuous protective layer containing $Al_2O_3$ and $Cr_2O_3$ on its surface. Further, the alloy can be thermomechanically processed to provide a fine-grain microstructure to achieve the desired combination of strength and ductility that characterize this alloy.

The terms and expressions which are employed in this specification are used as terms of description and not of limitation. There is no intention in the use of such terms and expressions of excluding any equivalents of the features shown and described or portions thereof. It is recognized that various modifications are possible within the invention described and claimed herein.

The invention claimed is:

1. A precipitation hardenable, cobalt-nickel base superalloy consisting essentially of, in weight percent:

| | |
|---|---|
| C | 0.01-0.1 |
| Cr | 8-15.00 |
| Ni | 34.00-41.00 |
| W | 3.00 to 12.00 |
| Ti | 0.50 to 2.00 |
| Al | 3.00-5.00 |
| Nb | up to 2.0 |
| Ta | up to 5.0 |
| Hf | up to 0.5 |
| Zr | up to 1.0 |
| B | up to 0.1 |
| Mo | up to 2.0 |
| Si | up to 1.0 |

the balance being cobalt and impurities.

2. The alloy as claimed in claim 1 which contains at least 0.50% tantalum.

3. The alloy as claimed in claim 1 in which the balance contains at least 35% cobalt.

4. The alloy as claimed in claim 1 which contains at least 0.02% carbon.

5. The alloy as claimed in claim 1 which contains at least 0.6% titanium.

* * * * *